US005667372A

United States Patent [19]

Hwang et al.

[11] Patent Number: 5,667,372

[45] Date of Patent: Sep. 16, 1997

[54] ROLLING PISTON ROTARY COMPRESSOR FORMED WITH LUBRICATION GROOVES

[75] Inventors: Seon-Woong Hwang; Chang-Joo Shin, both of Kyungki-Do, Rep. of Korea

[73] Assignee: LG Electronics Inc., Rep. of Korea

[21] Appl. No.: 451,510

[22] Filed: May 26, 1995

[30] Foreign Application Priority Data

Jun. 2, 1994 [KR] Rep. of Korea ..... 12787/1994

[51] Int. Cl.[6] ..... F04C 18/356; F04C 29/02

[52] U.S. Cl. ..... 418/63; 418/94

[58] Field of Search ..... 418/63, 94; 184/6.16

[56] References Cited

U.S. PATENT DOCUMENTS

| | | | |
|---|---|---|---|
| 2,199,762 | 5/1940 | Smith | 418/63 |
| 2,246,275 | 6/1941 | Davidson | 418/94 |
| 2,258,425 | 10/1941 | Smith | 418/63 |
| 2,306,608 | 12/1942 | Hubacker | 418/63 |
| 4,710,111 | 12/1987 | Kubo | 418/94 |
| 5,116,208 | 5/1992 | Parme | 418/63 |

FOREIGN PATENT DOCUMENTS

| | | | |
|---|---|---|---|
| 60-228793 | 11/1985 | Japan | 418/63 |
| 61-229985 | 10/1986 | Japan | 418/63 |
| 63-255589 | 10/1988 | Japan | 418/63 |
| 1813926 | 5/1993 | Russian Federation | 418/94 |

*Primary Examiner*—John J. Vrablik

*Attorney, Agent, or Firm*—Ostrolenk, Faber, Gerb & Soffen, LLP

[57] ABSTRACT

A rotary compressor is disclosed. The compressor reduces frictional loss in a contact part between the rolling piston and the eccentric sheave and in contact parts between the crankshaft and the main and sub bearings by achieving smooth lubrication to the contact parts. In the compressor, a lubricating groove is formed on the outer surface of the eccentric sheave. A hole communicating with the internal oil conduit of the crankshaft is formed in the lubricating groove and supplies oil from the oil conduit to the outer surface of the sheave. Lubricating grooves are also formed on the inner surfaces of the main and sub bearings so as to facilitate oil supply for the contact parts between the crankshaft and the bearings.

4 Claims, 11 Drawing Sheets

ROLLING PISTON ROTARY COMPRESSOR FORMED WITH LUBRICATION GROOVES

BACKGROUND OF THE INVENTION

1. Field of the Invention

The present invention relates in general to rotary compressors and, more particularly, to a structural improvement in such rotary compressors for achieving smooth lubrication to the contact part between inner surface of a rolling piston and outer surface of an eccentric sheave of crankshaft and to the contact part between the crankshaft and bearings and thereby improving operational performance of the rotary compressors and prolonging life of the rotary compressors.

2. Description of the Prior Art

With reference to FIG. 1, there is shown a typical rotary compressor. As shown in the drawing, the typical cylindrical rotary compressor 100 includes a vertically placed crankshaft 1 which rotates in a cylinder 13 by rotational force transmitted thereto through a power transmission mechanism.

A hollow cylindrical rotor 2 is tightly fitted over the crankshaft 1 through, for example, thermal fitting, thus to be integrated with the shaft 1 into an assembly. The compressor 100 also includes a hollow cylindrical stator 3 whose inner diameter is larger that the outer diameter of the rotor 2. The stator 3 is placed about the rotor 2 such that there is a gap between the rotor 2 and the stator 3.

The inner surface of the stator 3 is provided with a plurality of longitudinal slits (not shown) of a predetermined depth, the slits being spaced apart from each other at regular intervals.

A main bearing 4 and a sub-bearing 5 are fitted over the lower section of the crankshaft 1 such that the bearings 4 and 5 are spaced apart from each other at an interval. In this case, it is typical to place the main bearing 4 above the sub-bearing 5.

The portion of the crankshaft 1 between the bearings 4 and 5 is provided with an eccentric sheave 11 as shown in FIGS. 2 and 3. In addition, a ring type rolling piston 12, having an inner diameter larger than the outer diameter of the sheave 11, is placed about the sheave 11 such that the outer surface of the sheave 11 partially contacts with the inner surface of the rolling piston 12.

The rolling piston 12 is placed in a cylinder 13. The cylinder 13 has a linear reciprocating vane 14 which is elastically biased by a spring 14*a* placed in the outside of the cylinder 13. The tip of the spring-biased vane 14 always contacts with the outer surface of the rolling piston 12 in the circumferential normal direction of the piston 12 so that the vane 14 linearly reciprocates during eccentric rotation of the rolling piston 12.

In the left and right sides of the vane 14, a suction port 13*a* and an exhaust port 13*b* are formed by holing the inner wall of the cylinder 13. The cylinder 13 also includes an elbow type suction pipe 6 extending to the outside of the compressor 100. The suction pipe 6 radially extends from the cylinder 13 and in turn vertically extends upward as shown in FIG. 1.

The rotary compressor 100 is totally cased by a shell 7. The inside lower section of the shell 7 is filled with oil as shown in FIG. 1. The bottom center of the crankshaft 1 is provided with an oil suction port 21 for sucking the oil of the shell 7 into the crankshaft 1. A refrigerant exhaust pipe 8 is vertically fitted into the top center of the compressor 100.

An internal oil conduit 22 longitudinally extends in the crankshaft 1 from the top center to the bottom center of the shaft 1 as shown in FIG. 3. An oil port 23 is radially formed in the middle portion of the shaft 1 such that the port 23 lets the conduit 22 communicate with the outside of the shaft 1.

The oil conduit 22 also communicates with the outside of the shaft 1 at about the top and bottom centers of the eccentric sheave 11 through radial oil ports 24 and 25. With the oil ports 24 and 25, it is possible to lubricate the contact parts between the shaft 1 and the main and sub bearings 4 and 5.

An outer hole 11*a* is radially formed on the outer surface of the eccentric sheave 11 as shown in FIG. 4, while a connection hole 11*b* extending to the outer hole 11*a* is radially formed in the sheave 11 as shown in FIG. 5. With the outer hole 11*a* and the connection hole 11*b*, the internal oil conduit 22 of the shaft 1 communicates with the outside of the sheave 11.

Turning to FIGS. 7, 8A and 8B, the inner surface of each of the main and sub bearings 4 and 5 fitted over the shaft 1 is provided with a lubricating groove 30. This groove 30 extends from a start point 30*a* to a stop point 30*b*. Of course, it should be understood that the two points 30*a* and 30*b* may be interchanged each other.

In the drawings, the reference numeral 18 denotes an electric power terminal.

In operation of the above rotary compressor 100, expanded gas is sucked into the cylinder 13 through the suction pipe 6 and, at the same time, the eccentric sheave 11 rotates in accordance with rotation of the crankshaft 1. Due to rotation of the sheave 1, the rolling piston 12 which is placed in the cylinder 13 and contacts with the outer surface of the sheave 11 rotates in a given direction and thereby compressing the expanded gas in the cylinder 13 so as to produce high pressure and high temperature gas. The compressed gas in turn passes through the longitudinal slits of the stator 3 and is discharged from the compressor 100 through the exhaust pipe 9 in the top of the compressor 100.

The gas compression theory of the compressor 100 will be given hereinbelow with reference to FIG. 2.

When the expanded gas has been sucked into the cylinder 13 through the suction pipe 6, the rolling piston 12 whose outer surface contacts with the tip of the spring-biased vane 14 rotates along with the eccentric sheave 11 of the shaft 1, thus to eccentrically rotate in the cylinder 13.

In this case, the rolling piston 12 rotates and revolves in the same direction as the rotating direction of the shaft 1 while the spring-biased vane 14 contacting with the outer surface of the piston 12 linearly reciprocates.

As the piston 12 eccentrically rotates in a given direction under the condition that it is applied with pushing force of the spring-biased vane 14, the gas sucked into the cylinder 13 through the suction port 13*a* is compressed at every rotation of the piston 12 in the cylinder 13. The compressed gas in turn is discharged from the cylinder 13 through the exhaust port 13*b* while overcoming the spring force of an exhaust valve spring 13*c*.

FIG. 6A shows pulse signals of rotation period of the rolling piston 12 and FIG. 6B is a graph showing rotation speed of the rolling piston 12 as a function of exhaust pressure, and FIG. 6C shows a device for detecting the rotation speed of the piston 12.

The rotation speed of the piston varies in accordance with the frictional force which is generated between the eccentric sheave 11 and the inner surface of the piston 12 due to radially inward biasing force resulting from the suction gas pressure, the spring force of the vane spring 14*a* and the exhaust gas pressure. The rotation speed also varies in accordance with the frictional force generated between the tip of the vane 14 and the outer surface of the piston 12.

As shown in FIG. 6C, a pulse is generated whenever an insulating part 13*d* formed on the outer surface of the rolling piston 12 meets with an electrode 19 of the rotation speed detecting device.

As shown in FIG. 6A, the rotation speed of the piston 12 becomes 132 rpm when the exhaust pressure Pd is 1.57 M and, in this case, the pulses are generated at a rate of 2.2 pulses/sec. When the exhaust pressure Pd is 2.07 Mpa, the rotation speed of the piston 12 becomes 24 rpm and, in this case, the pulses are generated at a rate of 1 pulse/about 2.5 secs.

As shown in the graph of FIG. 6B, the pressure difference between the suction pressure and the exhaust pressure is increased in proportion to the exhaust pressure so that the frictional force acting on the piston 12 is increased while the rotation speed of the piston 12 is reduced. The rotation speed of the piston 12 becomes 212 rpm in the case of 0.61 Mpa exhaust pressure and becomes 32 rpm in the case of 2.06 Mpa exhaust pressure.

When the rotation speed of the rolling piston 12 in the cylinder 13 is increased as described above, the relative sliding speed between the vane tip and the piston 12 is remarkably reduced so that the vane tip is scarcely abraded. The operational efficiency of the compressor is thus improved and life of the compressor is thus prolonged.

During exhaust of the compressed gas through the exhaust port 13*b*, the oil A in the shell 7 is forcibly pumped up along the oil conduit 22 of the crankshaft 1 due to centrifugal force of the rotating crankshaft 1. While the oil A is pumped up in the conduit 22, the oil A flows out through the oil ports 23, 24 and 25 of the shaft 1 and through the radial hole 11*a* of the eccentric sheave 11. Therefore, the oil A lubricates the contact part between the inner surface of the piston 12 and the outer surface of the sheave 11 and reduces the frictional force generated between the piston 12 and the sheave 11.

The lubrication to the contact parts between the shaft 1 and the bearing 4 and 5 is achieved by the oil supplied to those contact parts through the lubricating grooves 30 formed on the inner surfaces of the bearings 4 and 5 as shown in FIGS. 7, 8A and 8B.

However, the above compressor has a problem that the oil can not be smoothly supplied to the portion of the sheave 11 opposed to the hole 11*a*.

Due to the deficient oil supply for the portion opposed to the hole 11*a*, the frictional force between the inner surface of the rolling piston 12 and the outer surface of the sheave 11 is increased and this reduces the rotation speed of the piston 12. The frictional force between the outer surface of the piston 12 and the vane 14 is thus increased so that the vane tip is more abraded so as to reduce the operational efficiency and to shorten life of the compressor.

In addition, the lubricating grooves 30 are partially formed on the inner surfaces of the main and sub bearings 4 and 5 as shown in FIGS. 8A and 8B, it is impossible to sufficiently supply the oil for the contact parts between the shaft 1 and the bearings 4 and 5. In this regard, the outer surface of the shaft 1 will be seriously scratched.

In an effort to solve the above problems, diameters and lengths of the main and sub bearings may be reduced so as to reduce the contact area between the crankshaft and the bearings and to prevent the frictional contact between the crankshaft and the bearings. However, there is a limit in reduction of the diameters and lengths of the bearings. Even when the diameters and lengths of the bearings are fortunately reduced, the rigidity of the crankshaft will be deteriorated so that the crankshaft may be easily broken during operation of the compressor. The reduction of the diameters and lengths of the bearings inevitably results in reduction of the lubricating groove size of the inner surfaces of the bearings so that the lubricating grooves of the bearings fail to supply sufficient amount of oil and cause frictional scratches on the crankshaft.

In addition, the refrigerant may be substituted with another refrigerant in an effort to solve the above problems. However, this method is accompanied with a problem that the pressure difference between the suction chamber and the compression chamber is increased. The torque acting on the crankshaft is thus increased so that the radius of the crankshaft needs to be increased in order for keeping operational reliability of the crankshaft. However, increase of the radius of the crankshaft can not help being accompanied with mechanical loss of the shaft.

SUMMARY OF THE INVENTION

It is, therefore, an object of the present invention to provide a rotary compressor in which the above problems can be overcome and which reduces both frictional loss and mechanical loss in a contact part between the inner surface of rolling piston and the outer surface of crankshaft eccentric sheave and in contact parts between the crankshaft and main and sub bearings by achieving smooth lubrication to the contact parts, thus to improve its operational performance and prolong its life.

In order to accomplish the above object, the present invention provides a rotary compressor including a cylinder having both a suction port and an exhaust port; a crankshaft rotating in the cylinder by rotational force transmitted thereto through a power transmission mechanism, the crankshaft having an eccentric sheave and a longitudinally extending oil conduit and a plurality of oil ports extending from the oil conduit to the outside of the crankshaft, the oil ports being radially formed in a middle portion of the crankshaft and in the crankshaft at the top and bottom of the sheave; a ring type rolling piston rotating and revolving in the cylinder by rotational force of the crankshaft, the inner surface of the rolling piston contacting with the outer surface of the eccentric sheave; a linear reciprocating vane elastically biased, in the cylinder, by a spring placed in the outside of the cylinder, the tip of the vane contacting with the outer surface of the rolling piston; and a main bearing and a sub-bearing fitted over a lower section of the crankshaft, wherein the improvement comprises: at least one first lubricating groove formed on the outer surface of the eccentric sheave; at least one hole formed in the lubricating groove and communicating with the oil conduit of the crankshaft and adapted for supplying of lubricating oil from the oil conduit to the outer surface of the sheave; and second lubricating grooves formed on the inner surfaces of the main and sub bearings and adapted for facilitating oil supply to the contact part between the crankshaft and the bearings during rotation of the crankshaft and for reducing contact area between the crankshaft and the bearings.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Please note that most of the elements of this compressor are common with those of the prior art compressor so that further explanation for the elements common to both the invention and the prior art is thus not deemed necessary.

Figure 9A:
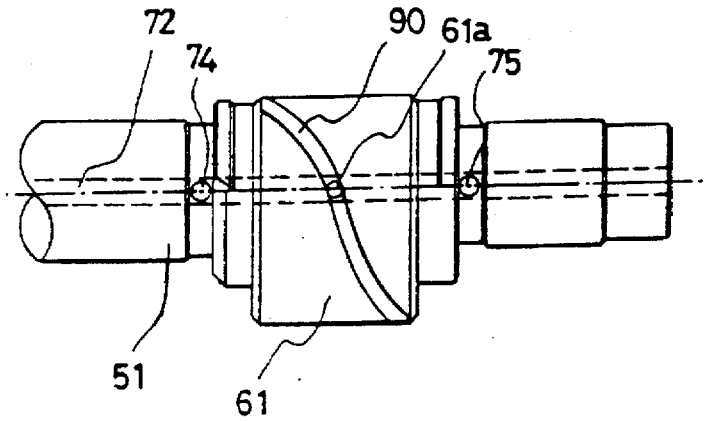
FIG. 9A is a side view of an eccentric sheave, having a spiral lubricating groove and a radial hole formed in the groove, of a crankshaft of a rotary compressor in accordance with an embodiment of the invention.

In an embodiment of FIG. 9A, a lubricating groove 90 is spirally formed on an eccentric sheave 61 of a crankshaft 51 and a radial hole 61*a* is formed in the groove 90. A connection hole (not shown) is radially formed in the sheave 61 so as to extend to the hole 61*a*. The hole 61*a* communicates with an internal oil conduit 72, longitudinally extending in the center of the shaft 51, through the connection hole.

Figure 9B:
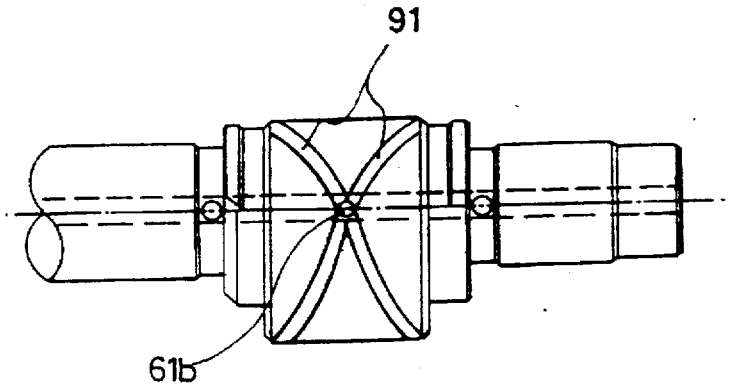
FIG. 9B is a side view of another embodiment of the eccentric sheave, having two cross spiral lubricating grooves and a radial hole formed at the cross point of the lubricating grooves.

Turning to FIG. 9B, there is shown another embodiment of the eccentric sheave 61 which has two cross spiral lubricating grooves 91 and a radial hole 61*b* formed at the cross point of the lubricating grooves 91. In the same manner as described for the embodiment of FIG. 9A, a connection hole (not shown) is radially formed in the sheave 61 so as to extend to the hole 61*b*. The hole 61*b* thus communicates with the internal oil conduit 72 of the shaft 51 through the connection hole.

Figure 9C:
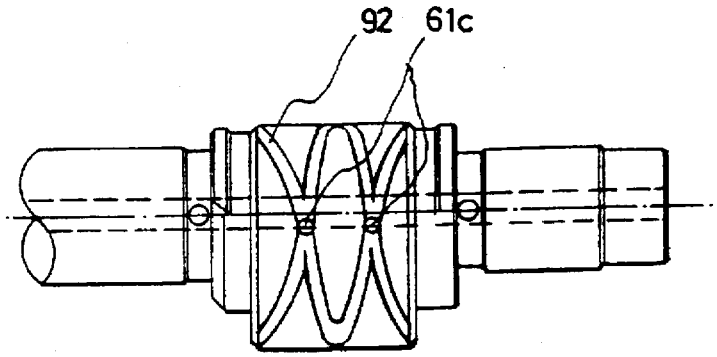
FIG. 9C is a side view of still another embodiment of the eccentric sheave, having two-turn left-hand spiral lubricating groove and two-turn right-hand spiral lubricating groove and two radial holes formed at the cross points of the grooves.

In an embodiment of FIG. 9C, a two-turn left-hand lubricating groove 92 and a two turn right-hand lubricating groove 92 are spirally formed on the eccentric sheave 61 such that the grooves 92 cross each other. Two radial holes 61*c* are formed at the cross points of the grooves 92. Connection holes (not shown) are radially formed in the sheave 61 so as to extend to the holes 61*c*. The holes 61*c* thus communicate with the internal oil conduit 72 of the shaft 51 through the connection holes.

Figure 9D:
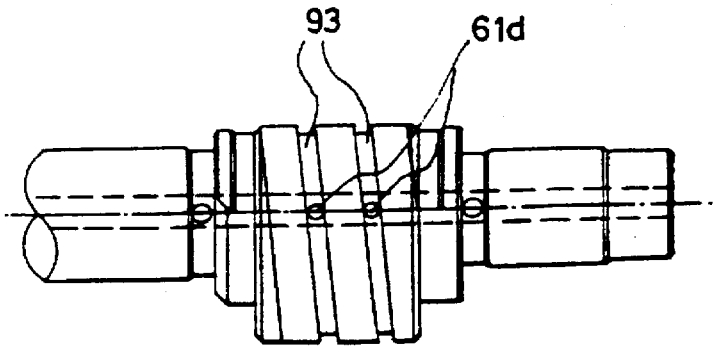
FIG. 9D is a side view of a further embodiment of an eccentric sheave, having a lead screw type lubricating groove and radial holes formed in the groove.

Turning to FIG. 9D, there is shown an eccentric sheave 61, having a lead screw type lubricating groove 93 and radial holes 61*d* formed in the groove 93. In the same manner as described for the embodiment of FIG. 9C, connection holes (not shown) are radially formed in the sheave 61 so as to extend to the holes 61*d*. The holes 61*d* thus communicate with the internal oil conduit 72 of the shaft 51 through the connection holes.

In the above rotary compressor, sufficient lubrication to the contact part between the rolling piston (not shown) and the sheave 61 is achieved due to the lubricating groove formed on the sheave 61. Therefore, the frictional contact area between the inner surface of the rolling piston and the outer surface of the sheave 61 is reduced and this improves mechanical efficiency of the compressor. In addition, the rotation speed of the rolling piston, which rotates in a cylinder (not shown) while contacting with the inner surface of the cylinder, is increased. The relative sliding speed between the rolling piston and a vane (not shown) is thus reduced. Frictional abrasion of the vane tip is prevented and this prolongs life of the compressor.

Figure 10A:
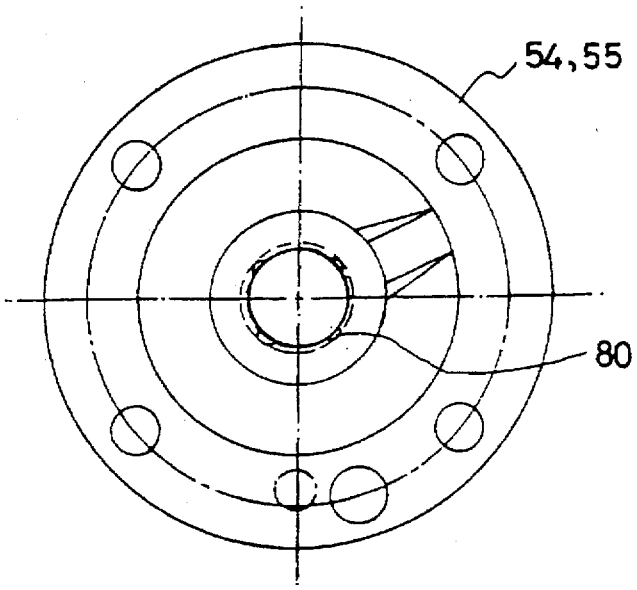
FIG. 10A is a plan view of a bearing, having four lubricating grooves formed on the inner surface of the bearing at 90° pitch, of the compressor of the invention.
Figure 10B:
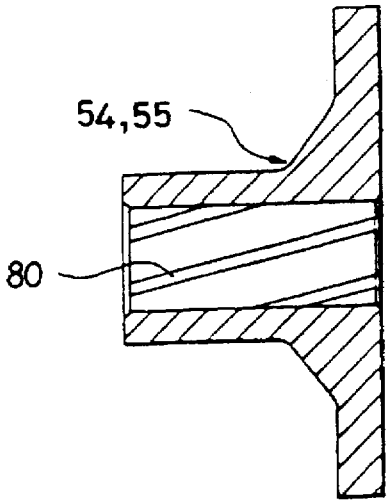
FIG. 10B is a side sectional view of the bearing of FIG. 10A.

As shown in FIGS. 10A and 10B, each of main and sub bearings 54 and 55 fitted over the crankshaft 51 of this invention may have four lubricating grooves 80 which are formed on the inner surface of the bearing at 90° pitch.

Figure 11A:
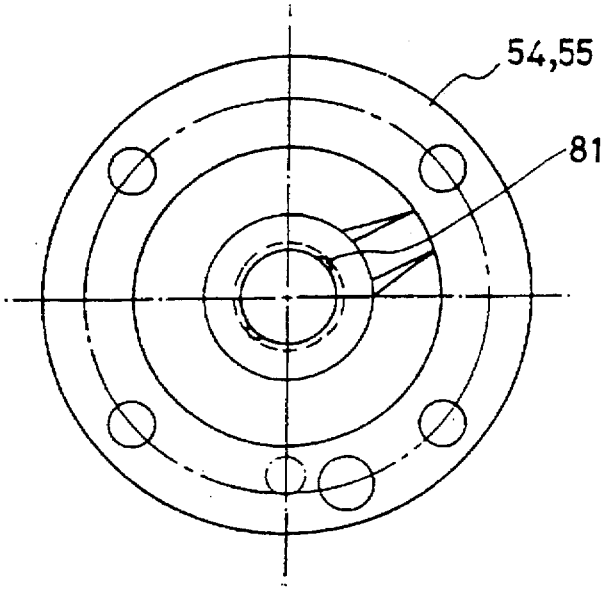
FIG. 11A is a plan view of another embodiment of the bearing, having two lubricating grooves formed on the inner surface at 180° pitch.
Figure 11B:
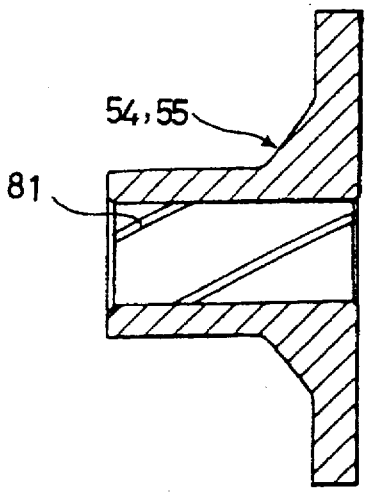
FIG. 11B is a side sectional view of the bearing of FIG. 11A.

Alternately, each of the main and sub bearings 54 and 55 of this invention may have two lubricating grooves 81 formed on the inner surface of the bearing at 180° pitch as shown in FIGS. 11A and 11B.

Figure 12A:
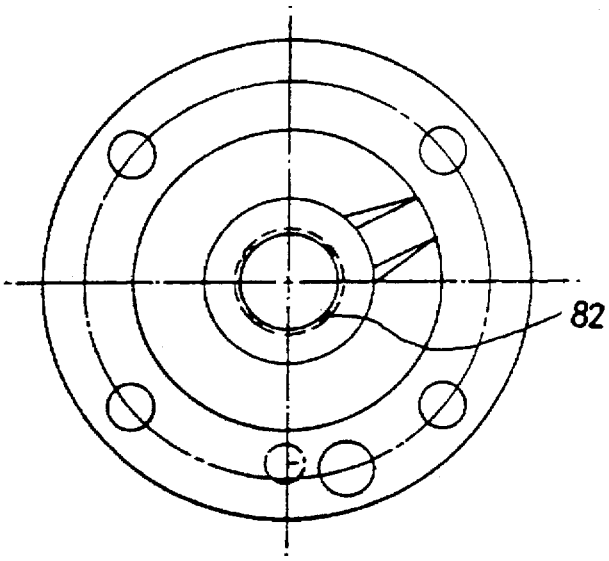
FIG. 12A is a plan view of a further embodiment of the bearing, having four lubricating grooves formed on the inner surface at 180° pitch.
Figure 12B:
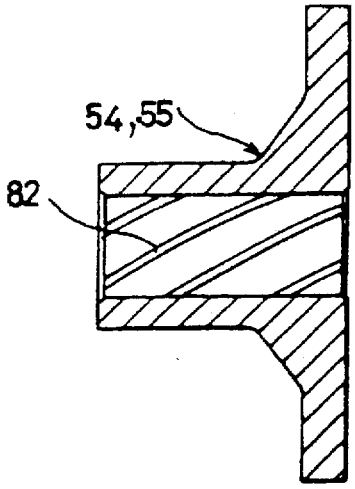
FIG. 12B is a side sectional view of the bearing of FIG. 12A.

As a further alternative, each of the main and sub bearings 54 and 55 may have four lubricating grooves 82 formed on the inner surface of the bearing at 180° pitch as shown in FIGS. 12A and 12B.

Figure 13A:
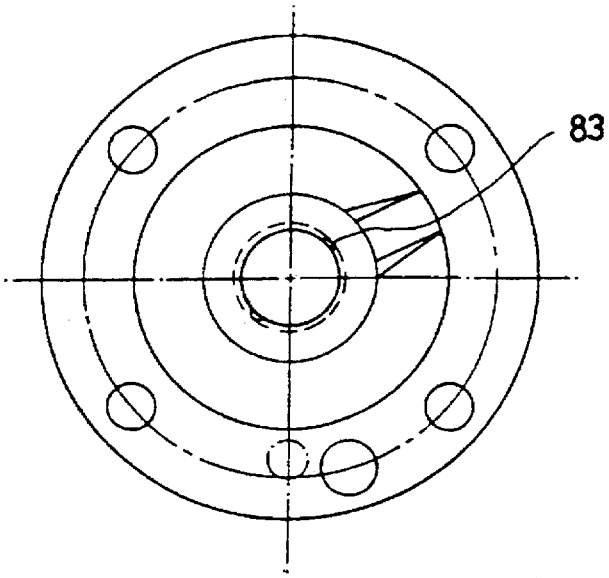
FIG. 13A is a plan view of yet another embodiment of the bearing, having two lubricating grooves formed on the inner surface at 360° pitch.
Figure 13B:
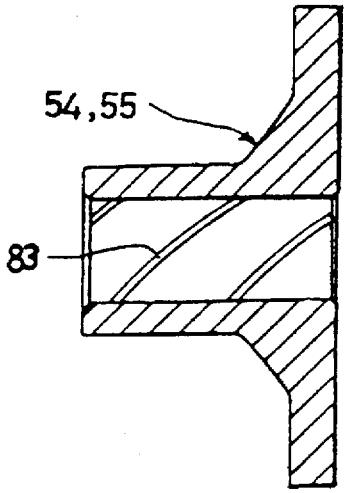
FIG. 13B is a side sectional view of the bearing of FIG. 13A.

In addition, each of the main and sub bearings 54 and 55 may have two lubricating grooves 83 formed on the inner surface of the bearing at 360° pitch as shown in FIGS. 13A and 13B.

Figure 14A:
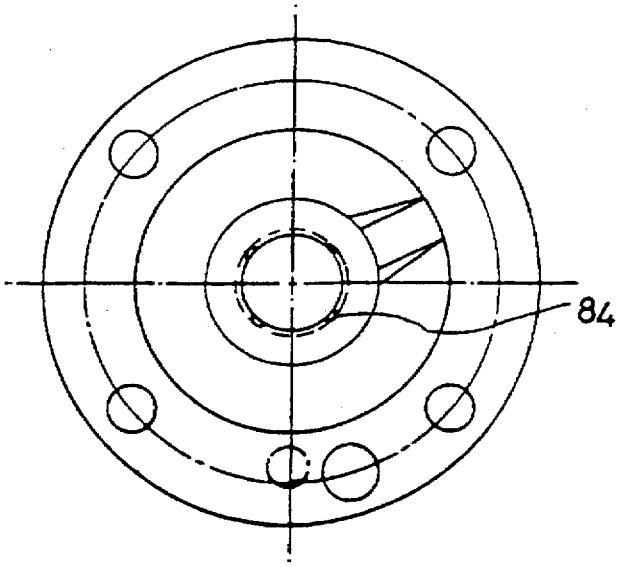
FIG. 14A is a plan view of yet another embodiment of the bearing, having four lubricating grooves formed on the inner surface at 360° pitch.
Figure 14B:
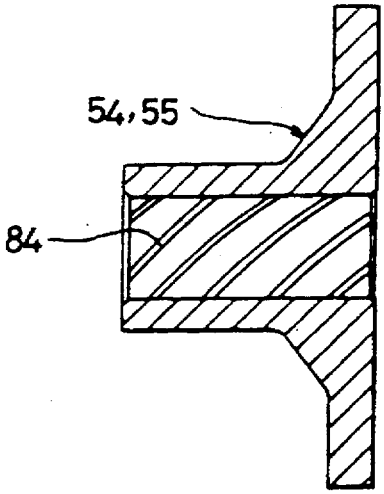
FIG. 14B is a side sectional view of the bearing of FIG. 14A.

Turning to FIGS. 14A and 14B, each of the main and sub bearings 54 and 55 may have four lubricating grooves 84 formed on its inner surface at 360° pitch.

Figure 15A:
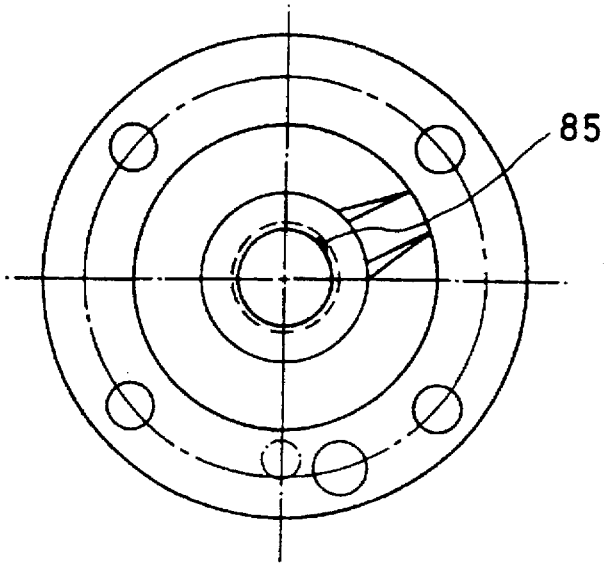
FIG. 15A is a plan view of yet another embodiment of the bearing, having a lubricating groove formed on the inner surface at 720° pitch.
Figure 15B:
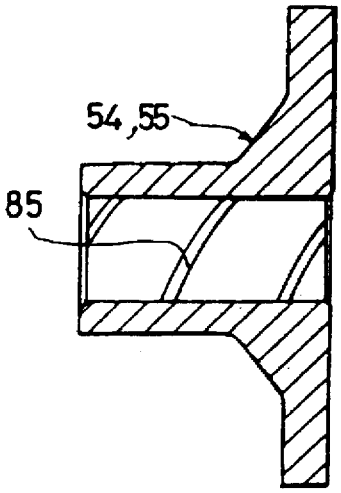
FIG. 15B is a side sectional view of the bearing of FIG. 15A.

As shown in FIGS. 15A and 15B, each of the main and sub bearings 54 and 55 may have a lubricating groove 85 formed on its inner surface at 720° pitch.

Figure 16A:
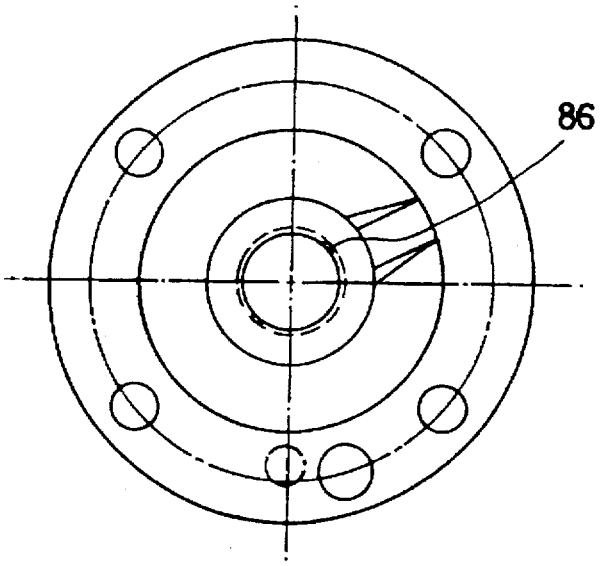
FIG. 16A is a plan view of yet another embodiment of the bearing, having two lubricating grooves formed on the inner surface at 720° pitch.
Figure 16B:
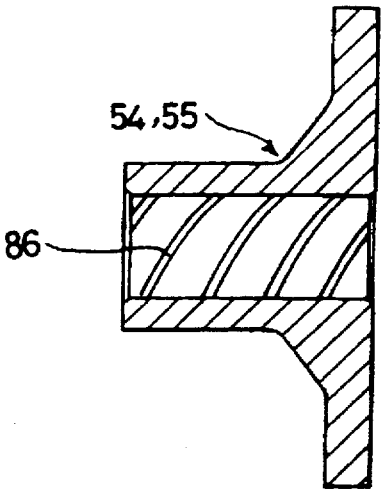
FIG. 16B is a side sectional view of the bearing of FIG. 16A.

Additionally, each of the main and sub bearings 54 and 55 of the invention may have two lubricating grooves 86 formed on its inner surface at 720° pitch as shown in FIGS. 16A and 16B.

In the compressor of this invention, the contact area between the crankshaft 51 and the bearings 54 and 55 can be reduced and the supplied oil amount can be increased with changing neither radius nor length of the crankshaft 51 as described above. In order to achieve the above object, the pitch of the lubricating groove formed on the inner surface of each bearing 54, 55 is changed between 90°, 180°, 360° and 720° so as to facilitate sufficient oil supply for the top section of the compressor during rotation of the crankshaft and to achieve more smooth lubrication to the contact part between the crankshaft 51 and the bearings 54 and 55. Such change of the pitch also reduces the contact area between the shaft 51 and the bearing 54 and 55 so as to reduce frictional loss of the compressor.

Figure 1:
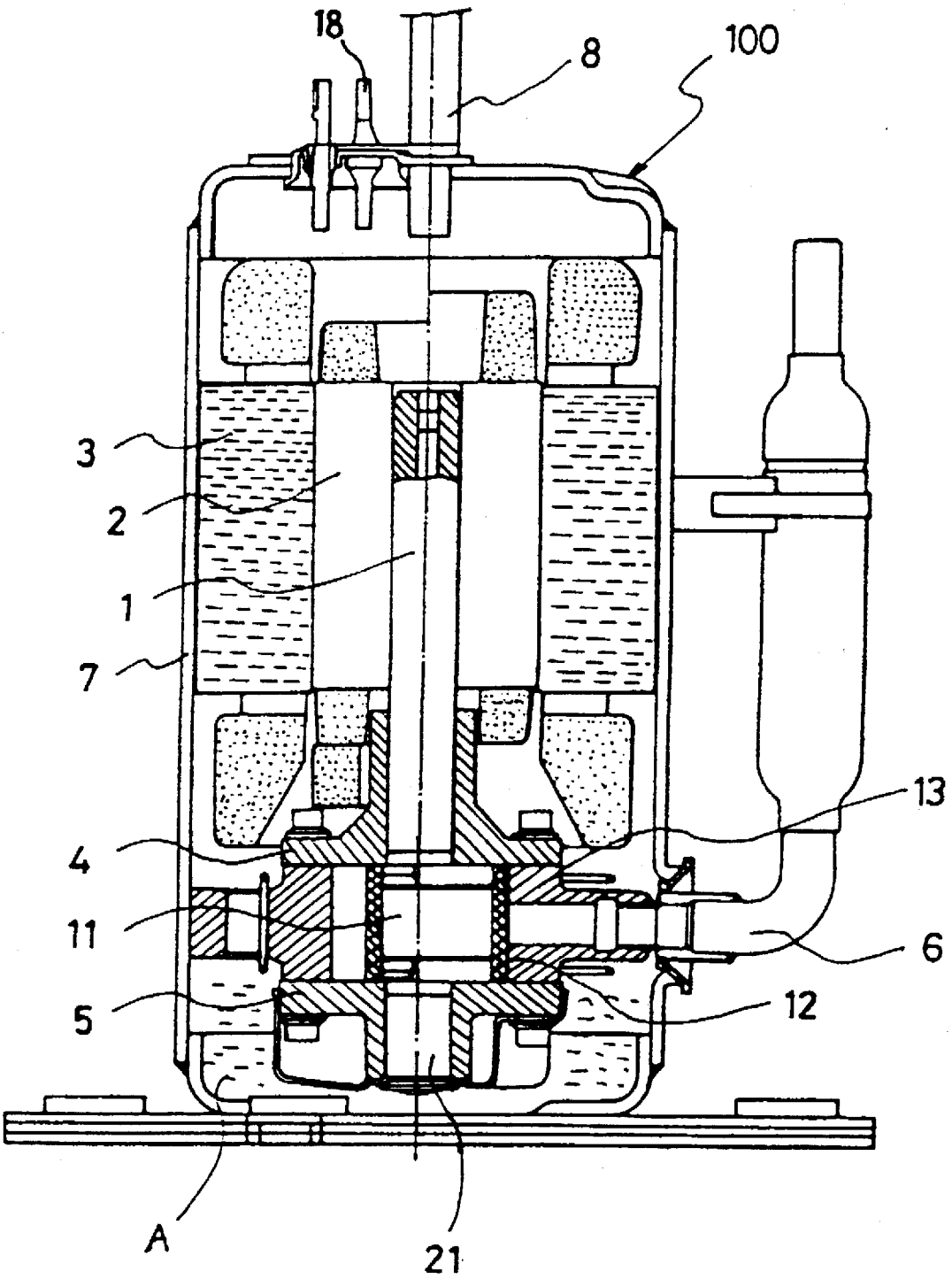
FIG. 1 CONVENTIONAL ART
FIG. 1 is a sectional view of a typical rotary compressor.
Figure 2:
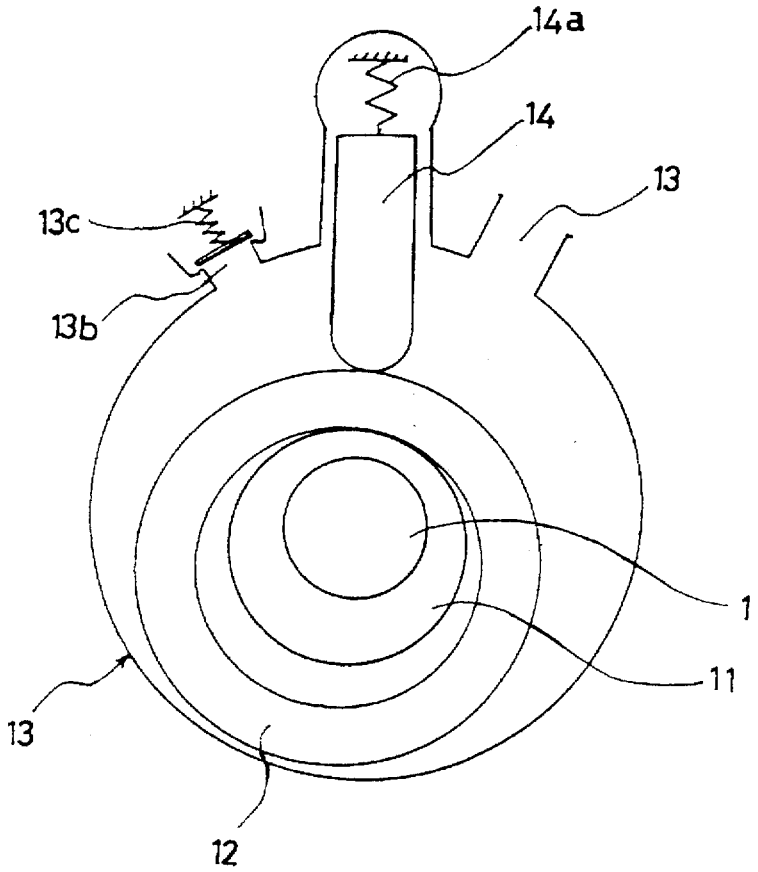
FIG. 2 CONVENTIONAL ART
FIG. 2 is a plan view of a cylinder part of the typical rotary compressor.
Figure 3:
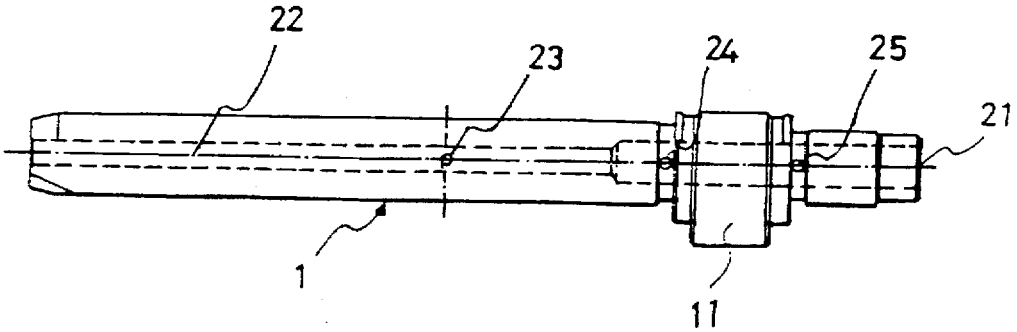
FIG. 3 CONVENTIONAL ART
FIG. 3 is a side view of a crankshaft of the typical rotary compressor.
Figure 4:
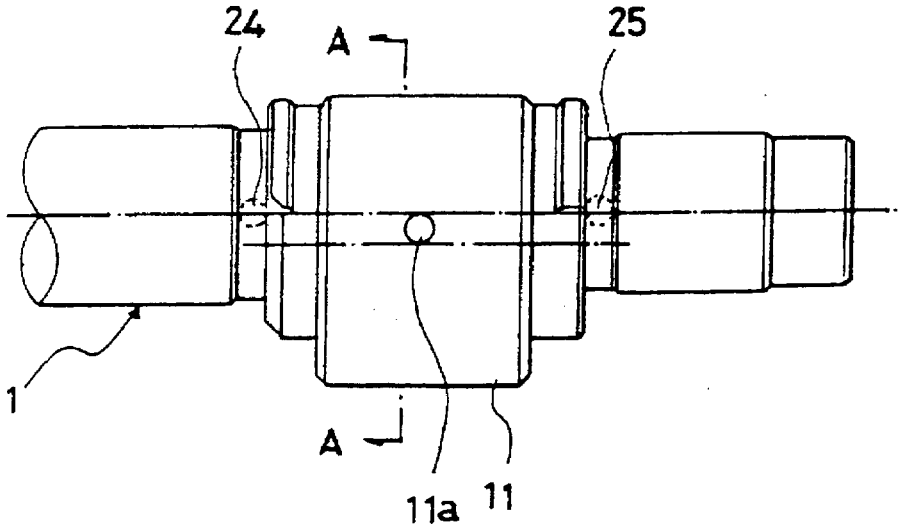
FIG. 4 CONVENTIONAL ART
FIG. 4 is a sectional view of an eccentric sheave of the crankshaft of the typical rotary compressor.
Figure 5:
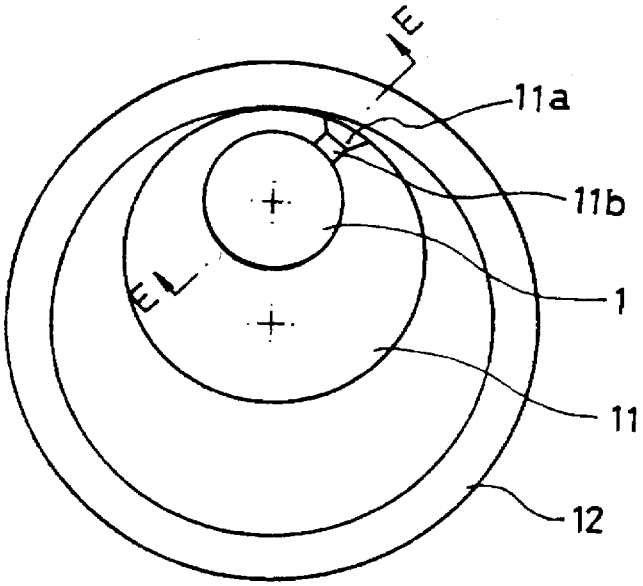
FIG. 5 CONVENTIONAL ART
FIG. 5 is a sectional view of the eccentric sheave taken along the section line 5—5 of FIG. 4.
Figure 6A:
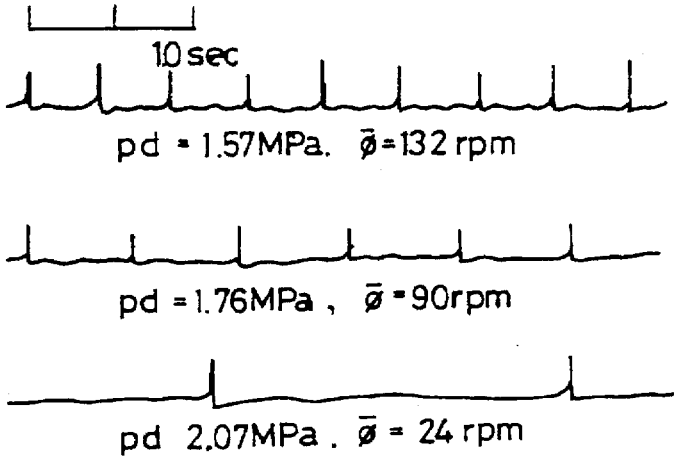
FIG. 6A CONVENTIONAL ART
FIG. 6A is a view showing pulse signals of rotation period of a rolling piston of the typical rotary compressor.
Figure 6B:
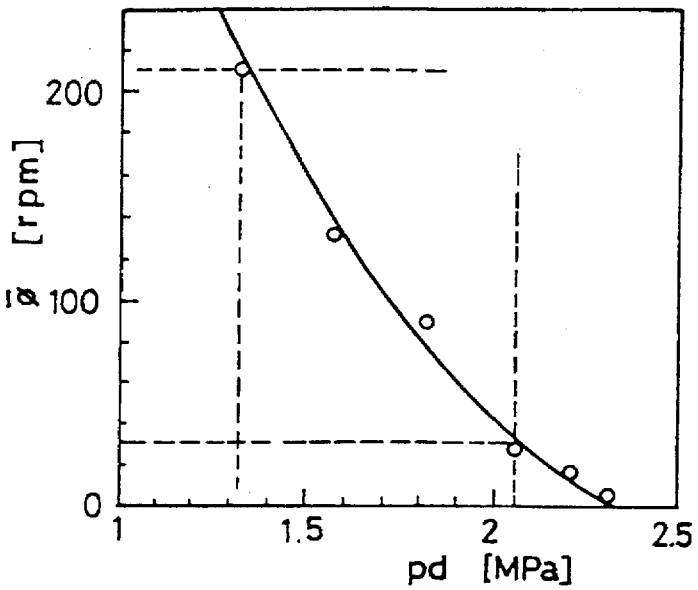
FIG. 6B CONVENTIONAL ART
FIG. 6B is a graph showing rotation speed of the typical rolling piston as a function of exhaust pressure.
Figure 6C:
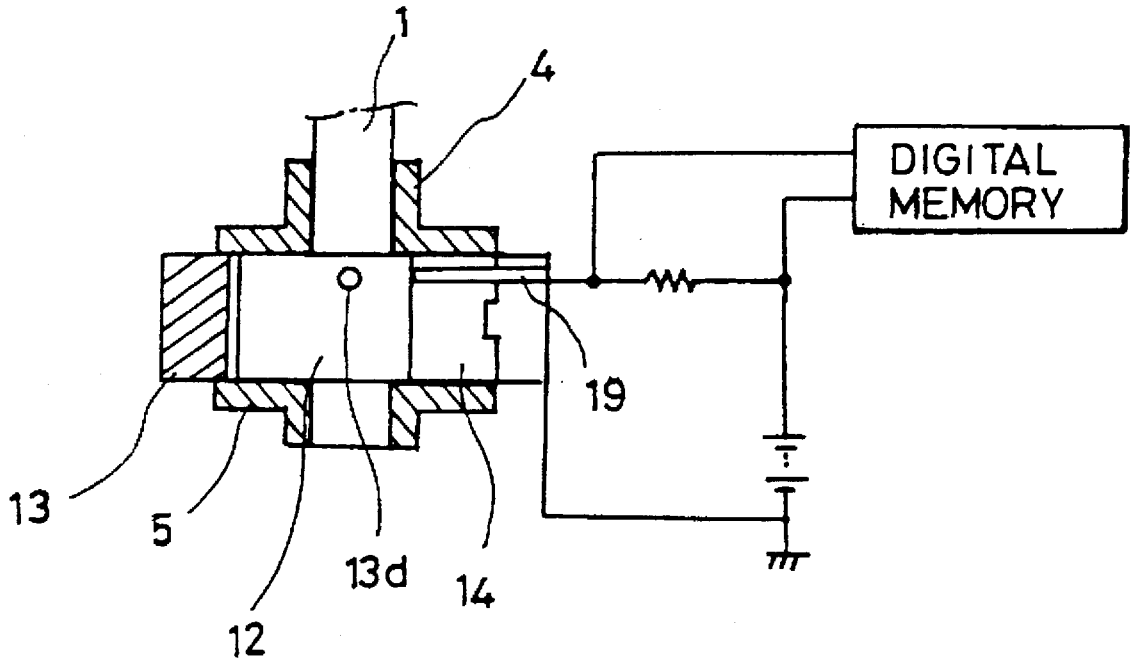
FIG. 6C CONVENTIONAL ART
FIG. 6C shows a device for detecting the rotation speed of the typical rolling piston.
Figure 7:
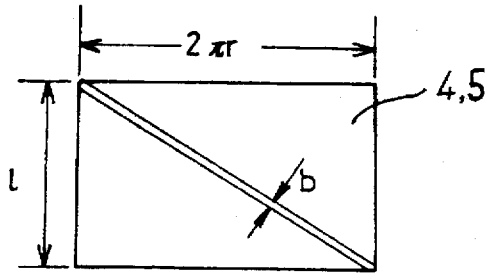
FIG. 7 CONVENTIONAL ART
FIG. 7 is a development view of a typical bearing fitted over the crankshaft, showing a lubricating groove formed on the inner surface of the bearing.
Figure 8A:
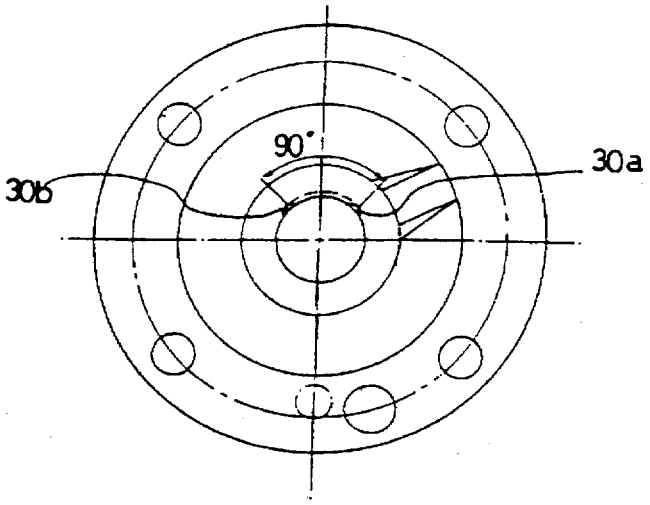
FIG. 8A CONVENTIONAL ART
FIG. 8A is a plan view of a typical bearing fitted over the crankshaft and having lubricating grooves formed on the inner surface of the bearing at 90° pitch.
Figure 8B:
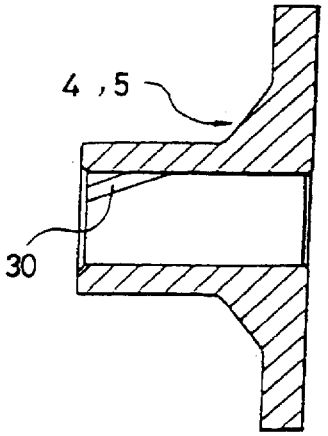
FIG. 8B CONVENTIONAL ART
FIG. 8B is a side sectional view of the bearing of FIG. 8A.

Hereinbelow, process for setting the contact area between the shaft 51 and the bearings 54 and 55 and for setting both the pitch and number of lubricating grooves of the bearings will be given with reference to, for example, FIGS. 7, 13A and 13B.

In the compressor, the contact area $A_1$ between the crankshaft 51 and a bearing 54, 55 is a cylindrical area and is represented by the following equation (1).

$$A_1=2\pi r\cdot l \quad (1)$$

wherein r is an inner diameter of the bearing, and l is a contact length between the crankshaft and the bearing.

When letting the pitch be 360°, the area $A_2$ of the lubricating groove 83 is represented by the following equation (2).

$$A_2=b\cdot[(2\pi r)^2=l^2)]^{1/2} \quad (2)$$

wherein b is a width of the lubricating groove of the bearing.

The variation of the contact area between the shaft 51 and the bearing per unit length variation of the inner diameter r is $2\pi l$.

In this case, when letting the variation of the lubricating groove area per unit length variation of the inner diameter r in the case of 360° pitch be $A_2'$ and letting $A_2'$ be 1, the ratio of $2\pi l$ to $A_2'$ is experimentally represented by the equation, $2\pi l:A_2'=1.8:1$.

The ratio of $2\pi l$ to $A_2'$ is influenced by both the length of the bearing and the width of the lubricating groove of the bearing.

When there are two lubricating grooves of 360° pitch in the bearing, the ratio of $2\pi l$ to $A_2'$ becomes 1.8/2, that is, $2\pi l:A_2'=1.8:2$. Hence, it is possible to offset the frictional force generated when the diameter r is increased by unit length 1.

When letting the variation of the lubricating groove area per unit length variation of the inner diameter r in the case of 720° pitch in the embodiment of FIGS. 15A and 15B be $A_2'$ and letting $A_2'$ be 1, the ratio of $2\pi l$ to $A_2'$ is experimentally represented by the equation, $2\pi l:A_2'=1.05:1$.

Therefore, when there is one lubricating groove of 720° pitch in the bearing, it is possible to offset the frictional force generated when the diameter r is increased by unit length 1.

It should be understood that the contact area between the shaft 51 and the bearings 54 and 55 and both pitch and number of lubricating grooves of the bearings in the embodiments of FIGS. 10 to 12 and 14 to 16 can be set in the same manner as described above.

As above-mentioned, the lubricating groove area of the main and sub bearings of this compressor can be increased by increasing both the number of lubricating grooves and the pitch of the grooves. It is thus possible to achieve the sufficient oil supply for the contact parts between the crankshaft and the bearings. Therefore, the compressor of this invention achieves the radius variation effect of the crankshaft without affecting the crankshaft strength. The compressor thus not only improves the mechanical efficiency and operational reliability but also reduces the frictional abrasion of the contact parts.

As described above, the rotary compressor of the present invention achieves smooth lubrication to the contact part between the outer surface of eccentric sheave of crankshaft and the inner surface of rolling piston and to the contact parts between the crankshaft and the main and sub bearings. The compressor thus reduces both frictional loss and frictional mechanical loss of the contact parts and improves the operational performance, and prolongs life.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. In a rotary compressor including a cylinder having both a suction port and an exhaust port; a crankshaft rotating in said cylinder by rotational force transmitted thereto through a power transmission mechanism, said crankshaft having an eccentric sheave and a longitudinally extending oil conduit and a plurality of oil ports extending from the oil conduit to an outside of the crankshaft, said oil ports being radially formed in a middle portion of the crankshaft and in the crankshaft at a top and bottom of said sheave; a ring type rolling piston rotating and revolving in said cylinder by rotational force of the crankshaft, an inner surface of the rolling piston contacting with the outer surface of the eccentric sheave; a linear reciprocating vane having a tip, said vane being elastically biased in the cylinder by a spring placed in an outside of the cylinder, the tip of said vane contacting with an outer surface of said rolling piston; and a main bearing and a sub-bearing fitted over a lower section of said crankshaft, the improvement comprising:

at least two first lubricating grooves formed in an outer surface of said eccentric sheave and intersecting each other;

at least one hole formed at the intersection point of the first lubricating grooves and communicating with the oil conduit of the crankshaft and adapted for supplying of lubricating oil from the oil conduit to the outer surface of the sheave; and second lubricating grooves formed on inner surfaces of said main and sub bearings and adapted for supplying oil to contacting parts between the crankshaft and the main and sub bearings during rotation of the crankshaft and for reducing contact between the crankshaft and the bearings.

2. The rotary compressor according to claim 1, wherein the first lubricating grooves are lead screw type grooves and at least two holes are formed in each turn of said grooves and positioned in line, respectively therein, in the longitudinal direction of the crankshaft.

3. The rotary compressor according to claim 1, wherein said second lubricating grooves are formed on the inner surfaces of the bearings at a pitch ranged from 90° to 720°.

4. In a rotary compressor including a cylinder having both a suction port and an exhaust port; a crankshaft rotating in said cylinder by rotational force transmitted thereto through a power transmission mechanism, said crankshaft having an eccentric sheave and a longitudinally extending oil conduit and a plurality of oil ports extending from the oil conduit to the outside of the crankshaft, said oil ports being radially formed in a middle portion of the crankshaft and in the crankshaft at the top and bottom of said sheave; a ring type rolling piston rotating and revolving in said cylinder by rotational force of the crankshaft, the inner surface of the rolling piston contacting with the outer surface of the eccentric sheave; a linear reciprocating vane elastically biased, in the cylinder, by a spring placed in the outside of the cylinder, the tip of said vane contracting with the outer surface of said rolling piston; and a main bearing and a sub-bearing fitted over a lower section of said crankshaft, the improvement comprising:

at least one first lubricating groove formed on the outer surface of said eccentric sheave;

at least one hole formed in the lubricating groove and communicating with the oil conduit of the crankshaft and adapted for supplying lubricating oil from the oil conduit to the outer surface of the sheave; and second lubricating grooves formed on the inner surfaces of said main and sub bearings and adapted for facilitating oil supply to the contact part between the crankshaft and the bearings during rotation of the crankshaft and for reducing contact area between the crankshaft and the bearings, wherein the at least one first lubricating groove is a lead screw type groove and at least two holes are formed in the groove and positioned in line, respectively therein, in the longitudinal direction of the crankshaft.

* * * * *